United States Patent [19]

Hayes et al.

[11] 4,149,389

[45] Apr. 17, 1979

[54] HEAT PUMP SYSTEM SELECTIVELY OPERABLE IN A CASCADE MODE AND METHOD OF OPERATION

[75] Inventors: Floyd C. Hayes, Onalaska; Merle A. Renaud; Paul R. Glamm, both of La Crosse, all of Wis.

[73] Assignee: The Trane Company, La Crosse, Wis.

[21] Appl. No.: 883,604

[22] Filed: Mar. 6, 1978

[51] Int. Cl.[2] ..... F25B 7/00; F25B 13/00

[52] U.S. Cl. ..... 62/79; 62/114; 62/160; 62/324; 62/335

[58] Field of Search ..... 62/79, 114, 335, 160, 62/324

[56] References Cited

U.S. PATENT DOCUMENTS

| | | | |
|---|---|---|---|
| 2,680,956 | 6/1954 | Haas | 62/335 |
| 2,707,869 | 5/1955 | Dennison | 62/157 |
| 2,869,335 | 1/1959 | Werden | 62/115 |
| 2,919,558 | 1/1960 | Lauer | 62/160 |
| 2,938,361 | 5/1960 | McNatt | 62/115 |
| 3,064,446 | 11/1962 | Dodge | 62/335 |
| 3,077,088 | 2/1963 | Japhet | 62/324 |
| 3,392,541 | 7/1968 | Nussbaum | 62/335 |
| 3,733,845 | 5/1973 | Lieberman | 62/114 |
| 3,852,974 | 12/1974 | Brown | 62/335 |

*Primary Examiner*—Lloyd L. King
*Attorney, Agent, or Firm*—Peter D. Ferguson; Carl M. Lewis

[57] ABSTRACT

A system is disclosed for the transfer of heat from an ambient heat sink of variable temperature to a conditioned space, said system being operable in a first mode when the temperature of the heat sink is at a relatively high level, and in a second mode when its temperature is at a relatively low level. The system includes a first refrigerant circuit which is operable in said first mode as a heat pump of the vapor compression type to absorb heat from the ambient heat sink and transfer same to the conditioned space. A second refrigerant circuit is provided which is operable in the second mode, when the temperature of the ambient heat sink is at a relatively low level, to absorb heat from the ambient heat sink and transfer same to the first refrigerant circuit, which then transfers the heat to the conditioned space. Thus, in second mode operation, the first and second refrigerant circuits operate in a "cascade" relationship. Suitable control means are disclosed for effecting operation of the system as described above, and, in addition, a suitable method of operation for such a system is disclosed.

25 Claims, 6 Drawing Figures

HEAT PUMP SYSTEM SELECTIVELY OPERABLE IN A CASCADE MODE AND METHOD OF OPERATION

BACKGROUND OF THE INVENTION

1. Field of the Invention

The present invention has application as a heat transfer system specifically adapted for use in the field of heating and air conditioning.

As the world's sources of fossil fuels such as oil and natural gas diminish, increased emphasis will be placed upon the use of electricity, which may be generated through the burning of coal or by nuclear reaction, in order to provide space heating of homes, commercial structures, and factories. One of the most energy-efficient systems utilizing electricity for the aforesaid heating applications is the wellknown vapor compression type heat pump. Although heat pumps of this type have been known for many years, and are today experiencing considerable popularity, such heat pumps have always experienced a common operating characteristic which is undesirable. That is, as the ambient heat source of the heat pump falls in temperature, the capacity of the heat pump system decreases drastically; while, at the same time, the heating needs of the space being conditioned increase. This problem has led to the extensive use of supplemental electrical resistance type heating, which is much less efficient than heat pump operation, and, in northern climates, has made heat pump usage less desirable.

2. Description of the Prior Art

The problems associated with low ambient heat pump operation have not gone unnoticed throughout the years, and several solutions to the problem have been proposed.

A first solution has been the provision of multiple compressors in the heat pump circuit which are selectively operable in series or compound relationship during low temperature operation; but which may be operated either in parallel, or one of the compressors may be rendered inoperative, during high temperature operation. Systems of this general character are disclosed in U.S. Pat. Nos. 2,919,558; 2,869,335; 2,938,361; 3,077,088; and are also described in articles appearing in Power Engineering, June, 1958, pages 72–74; and in Refrigerating Engineering, May 1956, pages 48–51.

A second solution to the aforementioned problem is disclosed in U.S. Pat. No. 3,392,541. The system disclosed in FIG. 1 thereof includes two separate refrigerant circuits which are operable in a first mode wherein evaporators 22 and 22a provide cooling, and in a second cascade mode wherein one of the circuits provides defrost or heating while the other continues to provide cooling. No provision is made for operating in a single stage heating mode. The system disclosed in FIG. 5 of this patent is similar to that of FIG. 1 except the second refrigerant circuit thereof is also reversible such that the system is always operable in a cascade mode to provide either cooling or defrost, or heating. Once again, no provision is made for single stage heating.

Yet a further solution is proposed in U.S. Pat. No. 2,707,869 wherein a system is disclosed having two refrigerant circuits, one of which is operable to absorb heat from a heat storage reservoir and transfer same to a conditioned space; the second of which is operable to absorb heat from an ambient heat sink and transfer same to the aforesaid heat storage material. At low ambient temperatures, the second circuit is rendered inoperable unless the temperature of the heat storage material reaches an unacceptably low level. Further, no provision is made for operating the first refrigerant circuit in a mode such that it may absorb heat directly from the ambient heat sink at such time as its temperature is at a relatively high level.

SUMMARY OF THE INVENTION, OBJECTS

The present invention represents a novel approach to the above-described problem existing with respect to prior art heat pump systems. The system disclosed is operable in a first mode when the temperature of an ambient heat sink is at a relatively high level and in a second mode when its temperature is at a relatively low level, and includes first and second refrigerant circuits. In the first mode, only the first refrigerant circuit is operable and includes first compressor means for compressing a vaporized first refrigerant, first heat exchange means to transfer heat from said compressed first refrigerant to the conditioned space, first expansion means to expand and reduce the pressure of the condensed first refrigerant, and second heat exchange means to transfer heat at ambient temperature from the ambient heat sink to the expanded first refrigerant. Thus, in the first mode, the system operates as a conventional vapor compression-type heat pump.

During the second mode operation, when the temperature of the ambient heat sink is at a relatively low level, the second refrigerant circuit is operable and includes second compressor means to compress a vaporized second refrigerant, third heat exchange means to transfer heat from the compressed second refrigerant to expanded first refrigerant, second expansion means to expand and reduce the pressure of the condensed second refrigerant, and fourth heat exchange means to transfer heat from the ambient heat sink to the expanded second refrigerant. Thus, in the second mode, the first and second refrigerant circuits are operable in cascade relationship to provide heating of the conditioned space, whereas, in the first mode, only the first refrigerant circuit operates as a single stage vapor compression-type heat pump.

Preferably, the first refrigerant circuit is also provided with reversing valve means such that the system is operable in a third mode to transfer heat from the conditioned space to the ambient heat sink and in a fourth mode to melt frost which accumulates on the second and fourth heat exchange means during operation in the first and second modes, respectively.

A preferred embodiment is disclosed showing a preferred flow arrangement which may be provided in a system of this general type. In addition, control means are disclosed for effecting selective operation of the system in its first and second modes in response to the condition of the ambient heat sink.

Accordingly, it is a primary object of the present invention to provide a heat pump system, method of operation, and control means therefor whereby a first refrigerant circuit is operable in a first mode, when the temperature of an ambient heat sink is at a relatively high level, to transfer heat as a heat pump of the vapor compression type from the ambient heat sink to a conditioned space; and a second refrigerant circuit is provided, operable in a second mode in conjunction with the first refrigerant circuit, to transfer heat from the ambient heat sink to the first refrigerant circuit which, in turn, transfers same to the conditioned space, thereby effecting operation of the first and second circuits in cascade relationships.

It is a further object of the present invention to provide a system in accordance with the object outlined above, which is further operable in a third mode to transfer heat from the conditioned space to the ambient heat sink through the use of reversing valve means associated with the first refrigerant circuit.

Yet a further object of the present invention is the provision of a system as described wherein first and second refrigerants serving as working fluids in the first and second refrigerant circuits, respectively, are selected so as to optimize operation of the system in both its first and second modes.

A fourth object of the present invention is to provide a system as described wherein the flow circuitry of the first and second refrigerant circuits is simplified to the extent possible and the number of components required therein is minimized. These and further objects of the present invention will become apparent from the following description of a preferred embodiment and by reference to the accompanying drawings.

DESCRIPTION OF A PREFERRED EMBODIMENT

Figure 1:
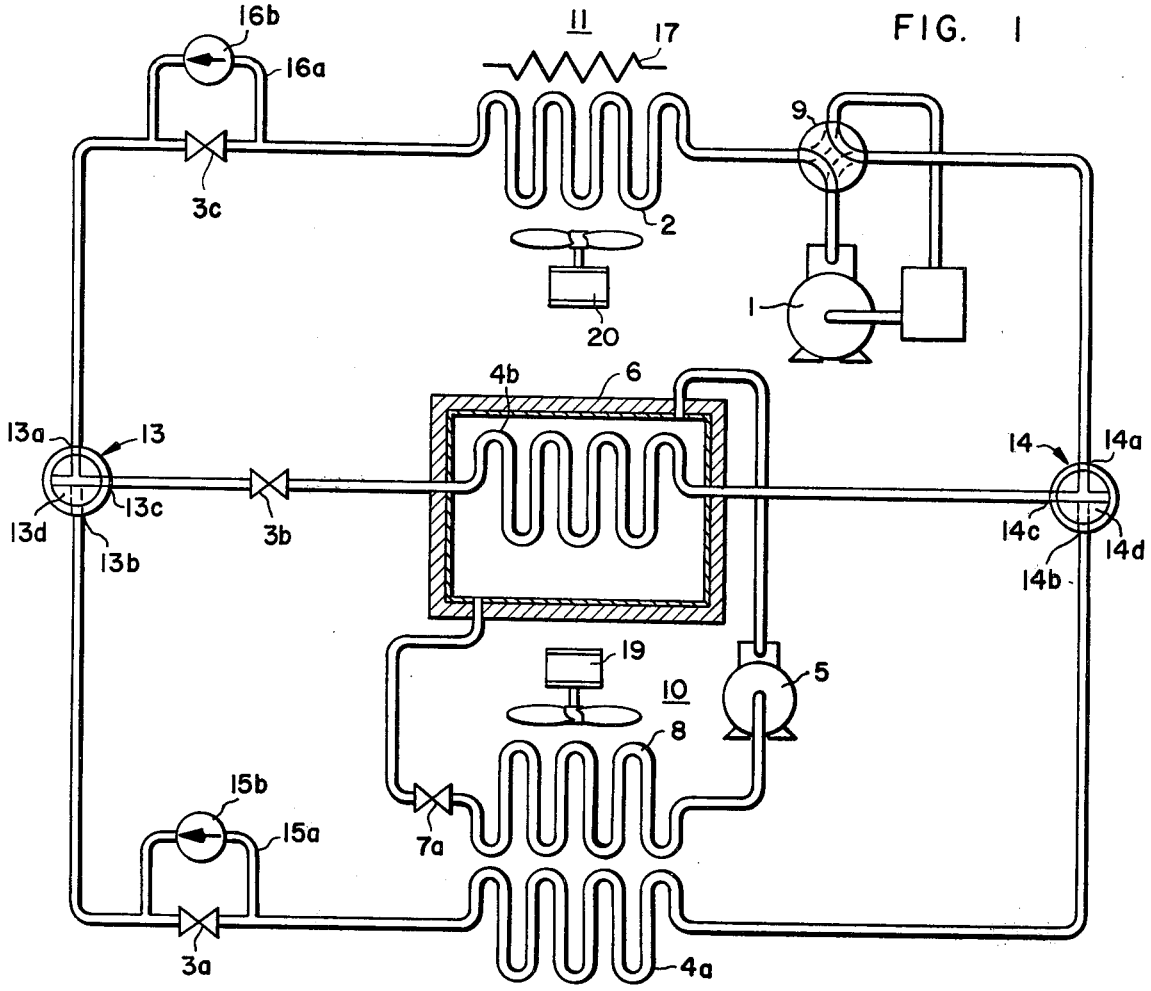
FIG. 1 is a schematic flow diagram of a preferred embodiment of the present invention.

Turning now to FIG. 1 of the drawings, a preferred embodiment of the present invention will be described.

The system illustrated in FIG. 1 includes a first refrigerant circuit including first compressor means 1, which may be of the reciprocating type, and are operable to compress a vaporized first refrigerant. First heat exchange means 2 are connected to compressor means 1 and are disposed with respect to a conditioned space 11 (see also FIG. 2) such that heat may be transferred thereby from compressed first refrigerant to the conditioned space. In practice, first heat exchange means 2 may comprise a fin-and-tube type heat exchanger including a suitable fan or blower for forcing air in heat exchange relation therewith and thereafter to conditioned space 11.

Connected to first heat exchange means 2 are first expansion means 3 which, in the embodiment of FIG. 1, comprise a first expansion device 3*a*, second expansion device 3*b*, and third expansion device 3*c*. Expansion devices 3*a–c* may comprise thermostatic expansion valves, capillary-type expansion means, or other conventional expansion devices.

Second heat exchange means are provided in the first refrigerant circuit of FIG. 1 which are connected to the first expansion means and, in the preferred embodiment of FIG. 1, include a first heat exchanger 4a and a second heat exchanger 4*b*, the operation of which will be described below. It should be noted, however, that first heat exchanger 4*a* is disposed with respect to an ambient heat sink of variable temperature 10 (see also FIG. 2) so as to be in heat transfer relationship therewith. In the preferred embodiment, the ambient heat sink comprises a source of air, in which case first heat exchanger 4*a* may comprise a fin-and-tube type heat exchanger and fan means such as shown at 19 may be provided for forcing said air in heat transfer relationship therewith.

The first refrigerant circuit further includes first valve means 13 and second valve means 14 which comprise three-way valves and are operative to direct flow of first refrigerant to either first heat exchanger 4*a* or second heat exchanger 4*b*, for reasons which will become apparent hereinafter. In lieu of three-way valves 13 and 14, two, two-way solenoid valves may be substituted for each, disposed in the individual inlet and outlet flow conduits of first heat exchanger 4*a* and second heat exchanger 4*b*.

In order that refrigerant flow may be reversed in the first refrigerant circuit, reversing valve means 9 are provided along with suitable bypass conduit means 15*a*, *b*, and 16 b around respective first and third expansion devices 3*a* and 3*c*.

The system of FIG. 1 further includes a second refrigerant circuit having second compressor means 5 operable to compress a vaporized second refrigerant and transfer same to third heat exchange means 6. As shown, third heat exchange means 6 is associated with second heat exchanger 4*b* of the first refrigerant circuit such that heat may be transferred from compressed second refrigerant to expanded first refrigerant, thus, third heat exchange means 6 and second heat exchanger 4*b* define a refrigerant-to-refrigerant heat exchanger.

The second refrigerant circuit includes second expansion means 7*a* connected to third heat exchange means 6, and fourth heat exchange means 8 connected thereto. Fourth heat exchange means 8 is disposed with respect to ambient heat sink 10 so as to be in heat transfer relationship therewith and, in the preferred embodiment, comprises a fin-and-coil disposed in an ambient air heat sink, further including fan means 19 for forcing air in heat transfer relationship therewith.

Figures 3A, 3B, 3C:
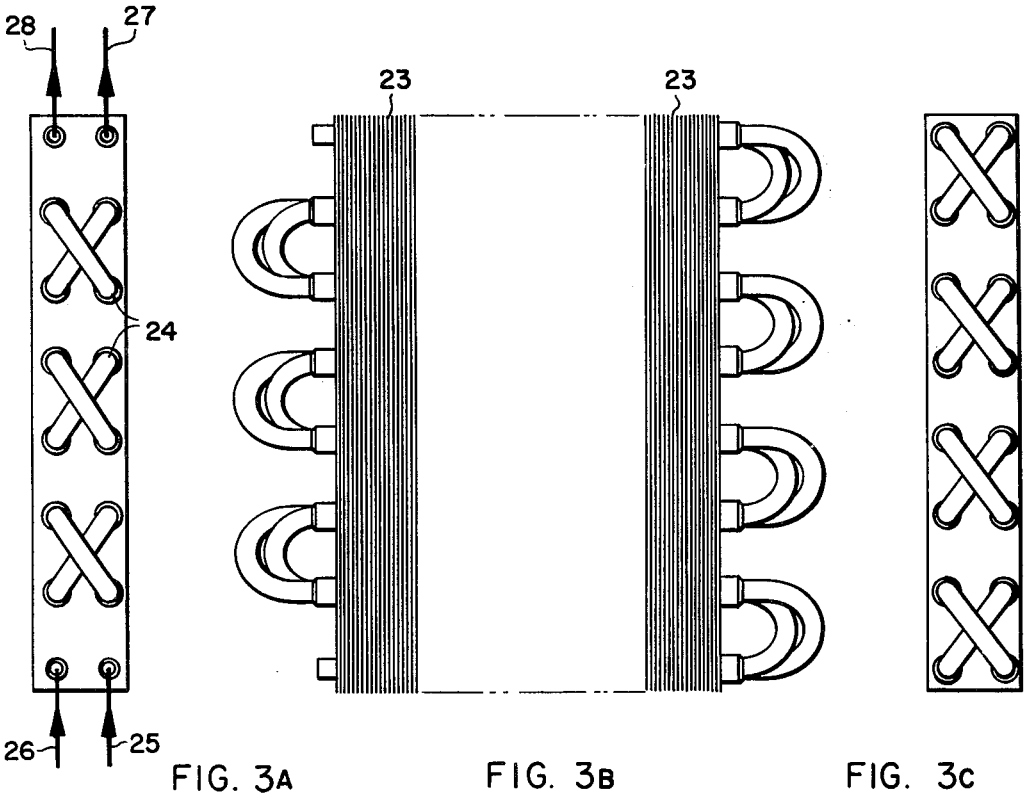
FIG. 3A, 3B and 3C are diagrammatic illustrations of a dual-circulated coil suitable for use in the system of FIG. 1.

In practice, it is desirable that first heat exchanger 4*a* and fourth heat exchange means 8 be combined to form a single coil of the fin-and-tube having a common bank of fin material, the tubes thereof being circuited so as to define a first flow path for first refrigerant (first heat exchanger 4*a*) and a second flow path for second refrigerant (fourth heat exchanger means 8). Such a coil is shown in FIGS. 3A through 3C and will be described in detail below.

Operation of FIG. 1

Operation of the system illustrated in FIG. 1 will now be described, which operation may occur in any one of four distinct modes.

In its first mode, compressor means 1 is operable to compress a vaporized first refrigerant, which is discharged therefrom through reversing valve means 9 to first heat exchange means 2, which is operable to transfer heat from the compressed first refrigerant to the conditioned space, thereby condensing the first refrigerant.

Condensed first refrigerant leaving first heat exchange means 2 then passes via bypass conduit means 16*a* and its associated one-way check valve 16*b* to port 13*a* of first valve means 13. During first mode operation, valve member 13d is in its dotted line position as shown in FIG. 1 such that the condensed first refrigerant may pass to first expansion device 3*a* of the first expansion means in order to expand and reduce the pressure of the condensed first refrigerant. The thus-expanded first refrigerant then passes into first heat exchanger 4*a* of the second heat exchange means which is operable in the first mode to transfer heat at ambient temperature from ambient heat sink 10 to vaporize the expanded first refrigerant, which then passes to port 14*b* of second valve means 14. Valve member 14*d* is in its dotted line position during first mode operation such that vaporized first refrigerant is directed to reversing valve means 9 to be returned to the first compressor means.

It is thus apparent, that during its first mode operation, the system of FIG. 1 is operative to transfer heat from ambient heat sink 10 to conditioned space 11, functioning as a vapor compression-type heat pump.

Turning now to second mode operation of FIG. 1, which occurs when the temperature of ambient heat sink 10 is at a relatively low level, the valve members 13*d* and 14*d* of respective first and second valve means 13 and 14 will be rotated to their full line positions as shown in FIG. 1, and reversing valve means 9 will remain in its full line position as in first mode operation.

Once again, compressed first refrigerant will be condensed by first heat exchange means 2 in order to transfer heat to conditioned space 11, which condensed refrigerant will then flow via bypass conduit means 16 *a, b* to port 13*a* of first valve means 13. Such refrigerant will pass via port 13*c* to second expansion device 3*b* of the first expansion means, and into second heat exchanger 4*b* of the second heat exchange means. In the second mode, second heat exchanger 4*b* is operable to transfer heat from a compressed second refrigerant (as will become apparent hereinafter) to expanded first refrigerant in order to vaporize same. Vaporized first refrigerant leaving second heat exchanger 4*b* will pass through port 14*c* of second valve means 14 to be returned via reversing valve means 9 to first compressor means 1.

Looking now at the second refrigerant circuit of FIG. 1, second compressor means 5 is operable in the second mode to compress a second vaporized refrigerant and discharge same into third heat exchange means 6, which, as described above, is associated with second heat exchanger 4*b* of the second heat exchanger means in order to transfer heat from compressed second refrigerant to expanded first refrigerant in second heat exchanger 4*b*, thereby to condense the compressed second refrigerant and vaporize the expanded first refrigerant.

Condensed second refrigerant exits third heat exchange means 6 and passes via second expansion means 7*a*, wherein its pressure is reduced, to fourth heat exchange means 8. Fourth heat exchange means 8 is operable in the second mode to transfer heat from ambient heat sink 10 to expanded second refrigerant to vaporize same, returning it to second compressor means 5.

Thus, in the second mode, the first and second refrigerant circuits of the system illustrated in FIG. 1 are operable in cascade relationship to transfer heat from ambient heat sink 10 to conditioned space 11.

The system of FIG. 1 is also operable in a third mode to transfer heat from conditioned space 11 to ambient heat sink 10, thus providing cooling of the conditioned space during summer months. During third mode operation, reversing valve means 9 is moved to the dotted line position of FIG. 1 such that compressed first refrigerant passes to port 14*a* of second valve means 14. Valve member 14*d* is in its dotted line position such that the compressed first refrigerant passes to first heat exchanger 4*a* of the second heat exchange means which is operable to transfer heat from compressed first refrigerant to ambient heat sink 10, condensing said first refrigerant.

The condensed first refrigerant leaves first heat exchanger 4*a* and passes via bypass conduit means 15*a* and its associated one-way check valve 15*b* to port 13*b* of first valve means 13. Valve member 13*d* is in its dotted line position of FIG. 1 such that the condensed refrigerant passes to third expansion device 3*c* of the first expansion means where it is expanded and reduced in pressure, passing therefrom into first heat exchange means 2. In first heat exchange means 2, the expanded first refrigerant is vaporized by the transfer of heat from conditioned space 11, returning therefrom to first compressor means 1.

As is well-known to those skilled in the art, operation of the system of FIG. 1 in its first and second modes will result, under certain conditions, in the build-up of frost or ice on first heat exchanger 4*a* during first mode operation and fourth heat exchange means 8 during second mode operation. In order to effect defrost thereof, a fourth mode of operation is provided similar to third mode operation wherein compressed first refrigerant passes from first compressor means 1 via second valve means 14 to first heat exchanger 4*a*, wherein the first refrigerant is condensed and thereby melts the frost or ice on first heat exchanger 4*a*. Since, as described above, first heat exchanger 4*a* and fourth heat exchanger means 8 comprise a coil of the fin-and-tube type having a common bank of fin material (See FIGS. 3A, 3B and 3C), operation in the fourth mode also serves to melt frost or ice which has accumulated on fourth heat exchange means 8 during second mode operation.

The condensed first refrigerant then leaves first heat exchanger 4*a*, passes via bypass conduit means 15*a, b*, first valve means 13, and third expansion device 3*c* of the first expansion means to first heat exchange means 2, where the expanded first refrigerant is vaporized by heat transfer with conditioned space 11.

In order to prevent cold drafts within conditioned space 11 during fourth mode operation, electrical resistance type heating means 17 are provided and energized in order to reheat the air passing over first heat exchange means 2.

Figure 1A:
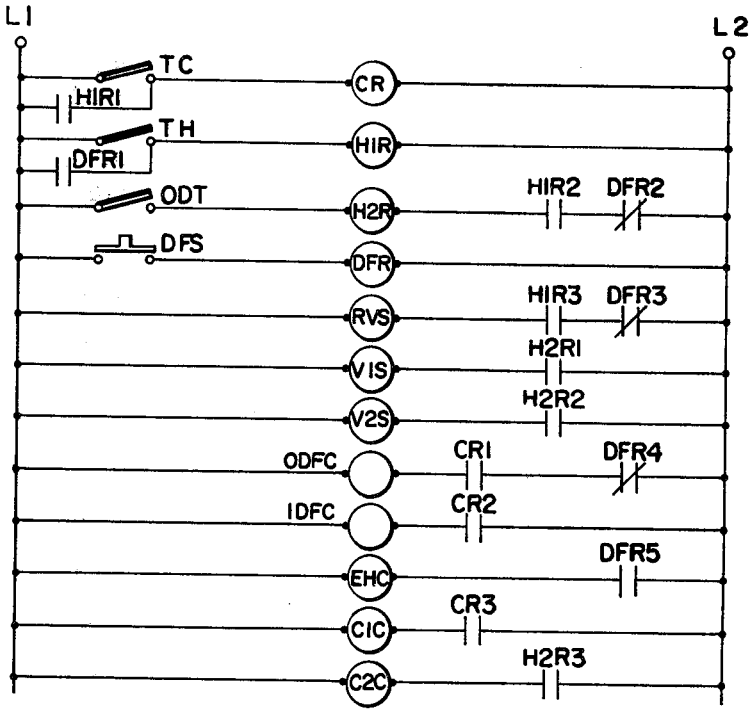
FIG. 1A is an electrical control circuit suitable for use with the system illustrated in FIG. 1.
Figure 2:
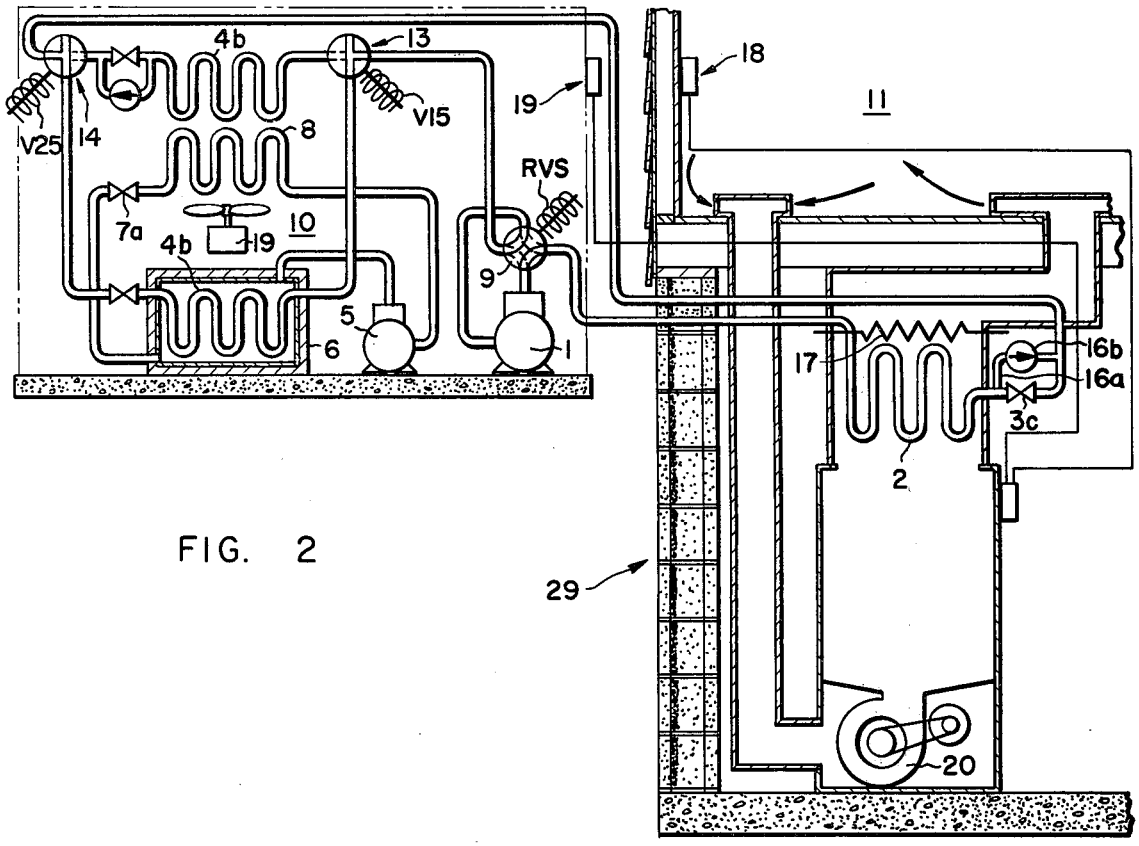
FIG. 2 is a generally schematic diagram illustrating the system of FIG. 1 as it might be installed to serve a typical residential dwelling.

Turning now to FIGS. 1A and 2 of the drawings, operation and control of the system of FIG. 1 will be described with respect to a specific installation thereof.

FIG. 2 illustrates in schematic fashion an installation of the system of FIG. 1 in one exemplary application, such as residential dwelling or structure 29.

As shown, first heat exchange means 2 is disposed within the structure and is associated with a forced air-type air conditioning system whereby air is circulated from conditioned space 11, over first heat exchange means 2 in heat transfer relationship therewith, and discharged into conditioned space 11. The remaining components of the system of FIG. 1 are disposed outside the structure whereby first heat exchanger 4*a* and fourth heat exchange means 8 may be disposed in heat transfer relationship with an ambient heat sink of variable temperature, such as a source of outside ambient air.

Control of the system of FIG. 1 is provided by an electrical control circuit such as that illustrated in FIG. 1A. As shown, a source of electrical power is provided by conductors L1 and L2 having connected therebetween a series of relays, solenoids, contactors, and temperature responsive switches designed to bring about the desired system operation.

Specifically, an indoor thermostat is provided, indicated generally at 18 of FIG. 2 which contains a first set of temperature responsive contacts TC and a second set of temperature responsive contacts TH. These contacts may be simple bi-metal type switches designed such that contacts TC close in response to a demand for cooling within conditioned space 11 and contacts TH close in response to a demand for heat therein.

Contacts ODT represent an outdoor thermostat, indicated generally by the reference numeral 19 in FIG. 2, which is operable to sense the temperature of ambient heat sink 10. It should be pointed out at this time, however, that in lieu of directly sensing ambient temperature, it is also possible to sense an operating condition of the first refrigerant circuit, such as suction pressure, which is indicative of ambient temperature in order to perform this control function.

In order to provide actuation of the various system components of FIG. 1, solenoid RVS is provided in order to actuate reversing valve means 9, solenoids V1S and V2S are provided for actuating first and second valve means 13, 14, respectively, outdoor fan contactor ODFC is provided for energizing outdoor fan means 19; indoor fan contactor IDFC is provided for energizing indoor fan means 20; electric heat contactor EHC is provided for energizing resistance-type electrical heating means 17; first compressor means contactor C1C is provided for energizing first compressor means 1; and second compressor means contactor C2C is provided for energizing second compressor means 5.

Connected in series with contacts TC, TH, ODT, and DFS are respective relays, CR, H1R, H2R, and DFR, which are operable to open or close their respective contacts shown in order to effect the desired system operation, which will not be described in detail.

In order to provide operation of the system of FIG. 1 in its first mode, heating contacts TH will close to produce a first signal indicating a demand for heat within conditioned space 11, thus energizing heating relay H1R. Normally open contacts H1R1 will thus be closed in order to energize cooling relay CR, causing closure of its normally open contacts CR1, CR2 and CR3, resulting in energization of first compressor means 1, outdoor fan means 19, and indoor fan means 20. In order that reversing valve means 9 be in its first mode position, solenoid RVS is energized via normally open contacts H1R3. This results in operation of the system of FIG. 1 in its first mode.

Assuming now that the temperature of ambient heat sink 10 is at a relatively low level, as sensed by outdoor thermostat 19, contacts ODT will close to produce a second signal and enable energization of relay H2R. Thus, under these conditions, when contacts TH close in response to a demand for heat within conditioned space 11, not only will relay H1R be energized but, due to closure of contacts H1R2, relay H2R will also be energized. Energization of relay H2R results in closure of its normally open contacts H2R1 and H2R2 in order to energize solenoids V1S and V2S, respectively, thus placing first and second valve means 13 and 14 in their respective second mode operating positions. Similarly, closure of normally open contacts H2R3 results in energization of second compressor means contactor C2C to operate second compressor means 5.

In order to effect operation of the system of FIG. 1 in its third mode, whereby conditioned space 11 may be cooled, contacts TC will close, energizing relay CR to close its normally open contacts CR1, CR2, and CR3 to operate outdoor fan means 19, indoor fan means 20, and first compressor means 1. Since solenoid RVS is not energized in this mode, reversing valve means 9 will remain in its dotted line position as seen in FIG. 1. Similarly, solenoids V1S and V2S will not be energized and first and second valve means 13, 14 will remain in their dotted line positions.

In order to provide operation in the fourth mode described above, during which first heat exchanger **4*a* and fourth heat exchange means 8 may be defrosted, defrost control switch DFS is closed, resulting in energization of defrost relay DFR. Normally open contacts DFR1 will then be closed to "lock in" heating relay H1R until completion of the defrost cycle, nowithstanding opening of heating contacts TH. In order to prevent operation of second compressor means 5 during defrost, normally closed contacts DFR2 are provided in series with relay H2R such that, upon opening of contacts DFR2 and the resultant de-energization of relay H2R, energization of second compressor contactor CR2 will be terminated or prevented. In order to place reversing valve means 9 in its fourth mode position, normally closed contacts DFR3 are provided which open in order to de-energize solenoid RVS. Since it is undesirable that outdoor fan means 19 operate during defrost, normally closed contacts DFR4 are provided in series with outdoor fan contactor ODFC to de-energize same during deforst. Finally, in order to provide a source of heat to condtion space 11 during defrost, normally open contacts DFR5 are provided in series with electric heat contactor EHC. Note also that, since energization of solenoids V1S and V2S is prevented in the fourth mode, first and second valve means 13 and 14 will remain in their dotted line positions of FIG. 1**.

Turning now to FIGS. 3A through 3C of the drawings, a coil of the fin-and-tube type is disclosed having a common bank of fin material, the tubes thereof being circuited therethrough so as to define a first flow path for first refrigerant, thereby defining first heat exchanger **4*a*; and a second flow path for second refrigerant, thereby defining fourth heat exchange means 8**.

The coil of FIGS. 3A through 3C includes a common bank of fin material in the form of a plurality of parallel metallic plate fins 23, through which pass a plurality of parallel tube sections 24. As shown in the end view of FIG. 3A, one of said tube sections includes an inlet connection 25 and a second tube section includes and inlet connection 26. The end portions of the remaining tube sections are connected by means of a plurality of U-bends as shown such that alternate tubes of the array define a first flow path between inlet connection 25 and an outlet connection 28 and a second flow path between inlet connection 26 and an outlet connection 27. Thus, one of said flow paths may serve as first heat exchanger **4*a* and the other as fourth heat exchange means 8**.

In order to optimize the operational efficiency of the system disclosed, it is important that proper refrigerants be chosen for use in both the first and second refrigerant circuits. In this regard, it has been found that Refrigerant 22 (R-22, Chlorodifluoromethane) is eminently suitable for use in the first refrigerant circuit, while the refrigerant for the second refrigerant circuit may be selected from the group consisting of Refrigerant 13B1 (R-13B1, Bromotrifluoromethane), Refrigerant 32

(R-32, Methylene Fluoride) and Refrigerant 504 (R-504, an azeotrope of Methylene Fluoride and Chloropentafluoroethane). The named refrigerants for use in the second refrigerant circuit are desirable because they have a relatively high gas density during low ambient (second mode) operation, thus permitting the use of a compressor in the second refrigerant circuit of relatively small displacement. Further, these refrigerants exhibit a vapor pressure at temperatures corresponding to high outdoor ambient which is sufficiently low that the refrigerant can be safely contained within the system without resort to specifically designed high pressure components. R-32 has the further advantage of being stratospherically saft and not subject to allegations that it is harmful to the earth's ozone layer.

As used herein, the term "ambient heat sink" is intended to encompass a body or reservoir of thermal energy which may serve as either a source of heat for the disclosed system (during first and second mode operation) or a sink to which heat is rejected (during third mode operation).

Although the invention herein has been described with respect to an ambient heat sink of variable temperature wherein the heat sink preferably comprises a source of air, it is within the scope of the invention and within the term "ambient heat sink" that such source could comprise other naturally occurring sources of heat of variable temperature such as ponds, rivers, wells, or earthen structures. Similarly, although electrical resistance-type supplemental heating means are disclosed, it is within the scope of the invention to substitute other supplemental heating means such as fossil-fueled furnace or solar heating means.

Similarly, although the electrical control circuits disclosed in FIGS. 1A, 2A and 3A utilize relatively simple electro-mechanical elements, it is within the scope of the invention to substitute therefor solid-state electronic elements either in the form of hard-wire logic circuitry or a preprogrammed microprocessor or minicomputer.

While the invention has been described with respect to a preferred embodiment, it is to be understood that further modifications thereto will be apparent to those skilled in the art within the scope of the invention, as defined in the claims which follow.

We claim:

1. A system for the transfer of heat between a conditioned space and an ambient heat sink of variable temperature, said system being operable to transfer heat from said ambient heat sink to said conditioned space in a first mode then the temperature of said ambient heat sink is at a relatively high level and in a second mode when its temperature is at a relatively low level, said system comprising a. a first refrigerant circuit including
   i. first compressor means operable in said first and second modes to compress a vaporized first refrigerant,
   ii. first heat exchange means connected to said first compressor means operable in said first and second modes to transfer heat from said compressed first refrigerant to said conditioned space to condense said first refrigerant.
   iii. first expansion means connected to said first heat exchange means operable in said first and second modes to expand and reduce the pressure of said condensed first refrigerant, and
   iv. second heat exchange means connected to said first expansion means and said first compressor means selectively operable in said first mode to transfer heat at ambient temperature from said ambient heat sink to said expanded first refrigerant to vaporize same, and in said second mode to transfer heat from a compressed second refrigerant to said expanded first refrigerant to vaporize same, said vaporized first refrigerant being returned to said first compressor means in said first and second modes; and b. a second refrigerant circuit including
   i. second compressor means operable in said second mode to compress a vaporized second refrigerant,
   ii. third heat exchange means connected to said second compressor means and associated with said second heat exchange means, operable in said second mode to transfer heat from said compressed second refrigerant to said expanded first refrigerant to vaporize same and to condense said compressed second refrigerant,
   iii. second expansion means connected to said third heat exchange means means operable in said second mode to expand and reduce the pressure of said condensed second refrigerant, and
   iv. fourth heat exchange means connected between said second expansion means and said second compressor means operable in said second mode to transfer heat from said ambient heat sink to said expanded second refrigerant to vaporize same and return it to said second compressor means.

2. The system of claim 1 being further operable in a third mode to transfer heat from said conditioned space to said ambient heat sink and further comprising reversing valve means associated with said first refrigerant circuit and operable in said third mode to reverse refrigerant flow therein, whereby said second heat exchange means is operable to transfer heat from compressed first refrigerant to said ambient heat sink to condense said first refrigerant; said first expansion means is operable to expand and reduce the pressure of said condensed first refrigerant; and said first heat exchange means is operable to transfer heat to said expanded first refrigerant to vaporize same.

3. The system of claim 1 wherein said first refrigerant comprises R-22.

4. The system of claim 1 wherein said second refrigerant is selected from the group consisting of R-13Bl, R-32, and R-504.

5. The system of claim 1 wherein said first refrigerant comprises R-22 and said second refrigerant is selected from the group consisting of R-13Bl, R-32, and R-504.

6. The system of claim 1 wherein said ambient heat sink of variable temperature comprises a source of air.

7. The system of claim 1 further including control means for providing selective operation of said system in said first and second modes, said control means comprising;

a. means for sensing the demand for heat within said conditioned space and for producing a first signal in response to a demand for heat;
b. means for sensing a condition related to the temperature of said ambient heat sink and for producing a second signal when its temperature is indicated to be below a predetermined level;

c. first means for effecting operation of said system in said first mode in response to said first signal; and
d. second means for effecting operation of said system in said second mode in response to said first and second signals.

8. The system of claim 7 wherein said means for sensing the demand for heat within said conditioned space comprises means for sensing the temperature within said conditioned space.

9. The system of claim 7 wherein said means for sensing a condition related to the temperature of said ambient heat sink comprises means for directly sensing its temperature.

10. The system of claim 1 wherein said second heat exchange means comprise a first heat exchanger operable in said first mode to transfer heat at ambient temperature from said ambient heat sink to said expanded first refrigerant to vaporize same, and a second heat exchanger operable in said second mode to transfer heat from said compressed second refrigerant to said expanded first refrigerant to vaporize same.

11. The system of claim 10 wherein said third heat exchange means and said second heat exchanger define a refrigerant-to-refrigerant heat exchanger for providing heat transfer between said compressed second refrigerant and said expanded first refrigerant in said second mode.

12. The system of claim 10 wherein said ambient heat sink of variable temperature comprises a source of air and said first heat exchanger and fourth heat exchange means are disposed therein for direct heat transfer therewith.

13. The system of claim 12 wherein said first heat exchanger and said fourth heat exchange means comprise a coil of the fin-and-tube type having a common bank of fin material, the tubes thereof being circuited therethrough so as to define a first flow path for said first refrigerant and a second flow path for said second refrigerant, and wherein fan means are provided for forcing said air over said coil.

14. The system of claim 13 being further operable in a fourth mode to melt frost which accumulates on said coil during operation in said first and second modes and further comprising reversing valve means associated with said first refrigerant circuit and operable in said fourth mode to reverse refrigerant flow therein, whereby said first heat exchanger is operable to transfer heat from said compressed first refrigerant to said frost to thereby melt same and condense said first refrigerant; said first expansion means is operable to expand and reduce the pressure of said condensed first refrigerant; and said first heat exchange means is operable to transfer heat to said expanded first refrigerant to vaporize same.

15. The system of claim 10 wherein
a. said first and second heat exchangers are in parallel flow relationship with respect to each other, each being connected between said first expansion means and said first compressor means; and
b. first valve means are provided for selectively directing said first refrigerant to said first heat exchanger in said first mode and to said second heat exchanger in said second mode.

16. The system of claim 15 wherein said first valve means comprise a first three-way valve having an inlet port for receiving said first refrigerant, a first outlet port for directing said first refrigerant to said first heat exchanger, a second outlet port for directing said first refrigerant to said second heat exchanger, and a valve member for providing selective communication between said inlet port and one of said first and second outlet ports.

17. The system of claim 15 wherein second valve means are provided for selectively directing the vaporized first refrigerant from said first heat exchanger to said first compressor means in said first mode and from said second heat exchanger to said first compressor means in said second mode.

18. The system of claim 17 wherein said second valve means comprise a second three-way valve having a first inlet port for receiving vaporized first refrigerant from said first heat exchanger, a second inlet port for receiving vaporized first refrigerant from said second heat exchanger, an outlet port for directing said vaporized first refrigerant to said first compressor means, and a valve member for providing selective communication between one of said first and second inlet ports and said outlet port.

19. The system of claim 15 wherein said first expansion means comprise a first expansion device between said first valve means and said first heat exchanger, and a second expansion device between said first valve means and said second heat exchanger.

20. The system of claim 19 further operable in a third mode to transfer heat from said conditioned space to said ambient heat sink and further comprising
a. reversing valve means associated with said first refrigerant circuit and operable in said third mode to reverse refrigerant flow therein whereby said first heat exchanger is operable to transfer heat from said compressed first refrigerant to said ambient heat sink to condense said first refrigerant and said first heat exchange means is operable to transfer heat from said conditioned space to said expanded first refrigerant to vaporize same;
b. first bypass conduit means for permitting said condensed first refrigerant to bypass said first expansion device in said third mode;
c. said first expansion means further comprising a third expansion device connected between said first heat exchange means and said first valve means; and
d. second bypass conduit means for permitting condensed first refrigerant to bypass said third expansion device in said first and second modes.

21. The system of claim 20 wherein said first and second bypass conduit means include one-way check valves.

22. A method of transferring heat to a conditioned space from an ambient heat sink of variable temperature comprising the steps of:
a. compressing a vaporized first refrigerant;
b. transferring heat from said compressed first refrigerant to said conditioned space to condense said first refrigerant;
c. expanding said condensed first refrigerant to reduce its pressure;
d. transferring heat at ambient temperature from said ambient heat sink to said expanded first refrigerant to vaporize same when the temperature of said ambient heat sink is at a relatively high level and, when its temperature is at a relatively low level, executing the following steps (i.) through (v.):
i. compressing a vaporized second refrigerant,
ii. transferring heat from said compressed second refrigerant to said expanded first refrigerant to condense said second refrigerant and vaporize said first refrigerant.

iii. expanding said condensed second refrigerant to reduce its pressure, iv. transferring heat from said ambient heat sink to said expanded second refrigerant to vaporize same, and v. returning said vaporized second refrigerant to said compressing step (i.); and e. returning said vaporized first refrigerant to said compressing step (a.).

23. The method of claim 22 wherein said first refrigerant comprises R-22.

24. The method of claim 22 wherein said second refrigerant is selected from the group consisting of R-13Bl, R-32, and R-504.

25. The method of claim 22 wherein said first refrigerant comprises R-22 and said second refrigerant is selected from the group consisting of R-13Bl, R-32, and R-504.

* * * * *